United States Patent [19]

Ellison

[11] Patent Number: 4,678,433

[45] Date of Patent: Jul. 7, 1987

[54] OVEN SYSTEM HAVING A HEATED SNOUT AT ITS ENTRANCE END

[75] Inventor: Kenneth Ellison, Brampton, Canada

[73] Assignee: Hunter Engineering (Canada) Ltd., Mississauga, Canada

[21] Appl. No.: 814,324

[22] Filed: Dec. 30, 1985

[51] Int. Cl.[4] ..... F27B 9/28

[52] U.S. Cl. ..... 432/59; 432/8; 432/72

[58] Field of Search ..... 432/59, 8, 72; 34/35, 34/85

[56] References Cited

U.S. PATENT DOCUMENTS

| | | | |
|---|---|---|---|
| 2,743,529 | 5/1956 | Hayes | 432/72 |
| 3,604,824 | 9/1971 | Hardison | 432/72 |
| 3,874,091 | 4/1975 | Fukumoto | 432/59 |
| 3,917,444 | 11/1975 | Carthew | 34/35 |
| 3,947,235 | 3/1976 | Bornet | 432/72 |
| 4,021,192 | 5/1977 | Ferguson et al. | 432/72 |
| 4,098,007 | 7/1978 | Davis et al. | 432/72 |
| 4,140,467 | 2/1979 | Ellison et al. | 34/35 |
| 4,198,764 | 4/1980 | Ellison et al. | 432/59 |
| 4,217,090 | 8/1980 | Whike et al. | 432/72 |
| 4,326,342 | 4/1982 | Schregenberger | 432/59 |

*Primary Examiner*—Henry C. Yuen

*Attorney, Agent, or Firm*—Donald E. Hewson

[57] ABSTRACT

An oven system for curing coated product is provided, where the oven line has at least one oven zone, with an entrance end, and a port through which coated product enters into the oven line. Means are provided for capturing substantially all of the indraft air, at least at the entrance end of the oven, near the port, and balance fan means are provided for circulating that indraft air at least in a first volume to a heat exchanger, and then back to the oven line. Solvent-rich air within the oven is withdrawn by an exhaust fan, and is delivered to an afterburner whose principal source of fuel is the volatile solvent which comes off the coated product within the oven as it is curing. A snout is provided, extending away from the entrance end of the oven in a direction towards the flow of coated product into the oven, and the snout has at least one hollow duct which is positioned near the flow path for the coated product, usually over the flow path. The hollow duct receives at least a portion of the heated indraft air which is being returned to the oven line, and that heated air passes through the snout duct and into the oven. The heated duct functions as a radiant heater, by which the coated product may be heated without heating the coating material on it. Some heated air may be bled from the end of the heated duct furthest from the entrance port to the oven, so as to slightly preheat the indraft air as it travels towards and into the oven.

6 Claims, 4 Drawing Figures

OVEN SYSTEM HAVING A HEATED SNOUT AT ITS ENTRANCE END

FIELD OF THE INVENTION

This invention relates to oven systems of the sort through which coiled metal strip or other coated product is moved in a continuing manner so as to cure the heat-curable, solvent releasing coating material on the coated product. The oven system may be indirect fired, or it may be direct fired; but is one that has an afterburner. In particular, this invention relates to an oven system which has additional pre-heating means beyond the entrance end to the first zone of the oven for purposes of providing radiant heat for the moving coated product, promoting pre-release of the solvent from the coating material, and to increase the efficiency of the oven system.

BACKGROUND OF THE INVENTION

Co-pending application Ser. No. 773,532 filed Sept. 9, 1985 in the name of the inventor herein, and assigned to a common Assignee, teaches an indirect fired oven system which utilizes a balance air fan and an exhaust fan. An indraft is induced at the entrance and exit ends of the oven line by the balance air fan, which captures the indraft air at both ends almost immediately that it enters the oven line. Part of the indraft air is fed to a heat exchanger and thence back to the oven line, and the other part of the indraft air is fed back directly and unheated to the oven line. The temperature in the oven zones is controlled by the influx to each of the oven zones of heated air, under control of dampers. An exhaust fan exhausts the oven zones, and that includes taking the volatile solvent which is released from the coating material as it heats up in the oven. The output from the exhaust fan is fed to an afterburner for combustion, following which it flows past the heat exchanger and thence to an exhaust stack. No products of combustion are therefore fed directly to the oven line, or are in contact with the coated product as it moves through the oven.

However, it may sometimes occur that the oven line is, itself, fairly short, so that utilization of the full length or extent of the oven zone or zones for heating and curing the coated product is desirable. In heating and curing the coated product, it is desirable to ensure that the coated product itself —especially when the coated product is such as coiled strip metal—is heated to an optimum temperature at which the coating material is best cured; and it is often desired to maintain the sheet material at that optimum curing temperature. Because of the short period of time in which the coated product is within the oven, the oven zones are maintained at relatively high temperatures (500° F. or more), and various zones of the oven line may be maintained at differing temperatures depending on the purpose intended—such as solvent release, strip metal heating, or dwell—as the coated product travels through the oven line and at any point along the oven line. However, because the coating material contains a volatile and combustible solvent, which may be released from the coated material very rapidly, care must be taken that whatever volatile solvent is released in a gaseous form is captured.

Moreover, it may occur that if the volatile material is not totally captured, particularly at the entrance end of the oven line, where cold intake air is flowing, the volatile solvent may condense on cold surfaces.

It will sometimes occur that a shroud or guide hood is arranged at the entrance end of an oven line, and very often the volatile solvent will condense on the underside of that hood or shroud. When that happens, the condensate may drip onto the coated product as it is being directed into the oven, at which time it may cause blistering, or in the absence of coated product such as at change-over time or otherwise when the oven line is down, the condensate may drip onto the floor in front of the entrance end to the oven. Since the floor may very often be a concrete floor, the volatile solvent dripping onto it may cause severe pitting and other damage.

Another problem may occur when the entrance end of the oven is too cool, or when the coated product such as strip metal has to travel too far from the place where the coating is applied to the entrance of the oven, and that problem is that the coating material may begin to skin. That is, the outer surface of the coating material may harden and form a skin or membrane before the coating material is cured underneath the skin. When that happens, release of solvent from the coating material may occur at the wrong places in the oven, or too slowly; and it may also occur that the solvent may release violently, or it may boil through or past the skin that has set up, and therefore may cause further blistering and a poorly coated product.

Ideally, therefore, the material of the coated product should be heated before the solvent releasing coating material on it is heated. This is especially true, of course, and it is possible, when the coated product is metal. Moreover, because of the high speeds and short time periods that are permitted, such condition is most particularly ideal when coated coiled metal sheet such as aluminum or steel sheet is to be cured.

In order to achieve that condition, however, it is necessary that the coated product be radiantly heated. That is, the metal substrate beneath the solvent releasing coating material should be heated, rather than the coating material itself; and that can only occur in the absence of convection heating, so that radiant heating would be required.

The present invention provides a means whereby the coated product may not only be pre-heated, it may be radiantly heated so as to heat the metal substrate. Moreover, the present invention provides a means whereby better zone heating, particularly in the first zone, is achieved because less cold air enters the first zone of an oven line embodying the present invention. Still further, the present invention provides a means by which the likelihood of solvent condensing at or in front of the entrance to the oven is substantially reduced, if not precluded.

These achievements are gained by providing means for capturing substantially all the indraft air which enters the oven line at or near the entrance port to the oven line, which air is then circulated by a balance fan in at least a first volume to a heat exchanger, from which it is returned back to the oven line. The returning heated balance air is, in keeping with the present invention, at least in part directed to a snout which extends away from the entrance end of the oven line in a direction towards the flow of coated product as it moves towards the entrance port of the line, and the snout has at least one hollow duct which receives that portion of the heated indraft air directed towards it. The heated indraft air is then discharged into the oven line.

The structure of the present invention thereby provides a source of radiant heat, by which the coated product substrate may be heated without heating the coating material itself.

BRIEF DESCRIPTION OF THE DRAWINGS

A more detailed description of the present invention follows, in association with the accompanying drawings, in which.

DESCRIPTION OF THE PREFERRED EMBODIMENTS

The description which follows is with respect to a simplified and generalized representation and is made for the sake of simplicity and clarity of description, and without purposes of limitation. Obviously, circumstances for any particular oven line will vary, depending on the physical space in which it may be installed, as well as other factors such as the product or product range which is intended for curing in the oven line and the heating system for the oven line.

Figures 1, 2:
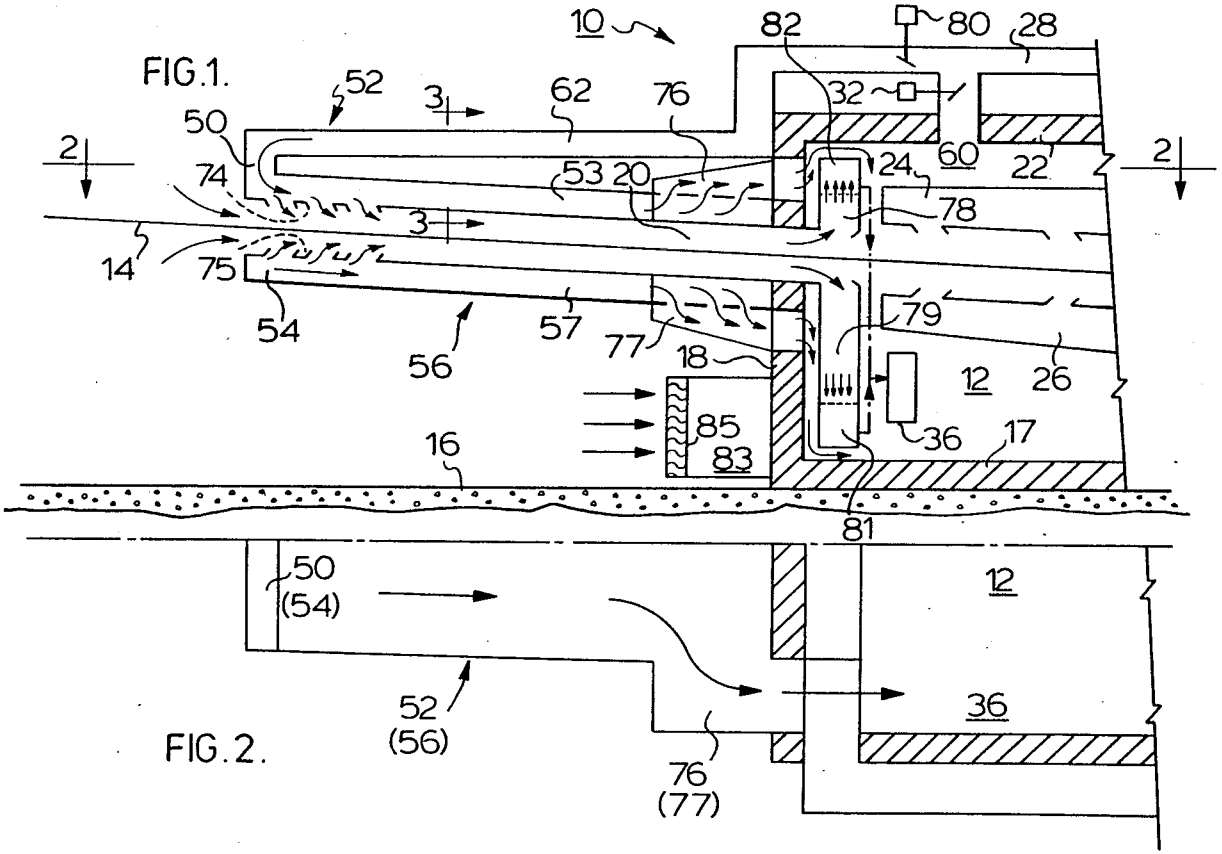
FIG. 1 is a simplified and generalized cross section through the entrance area of an oven embodying the present invention.
FIG. 2 is a half-plan view of the embodiement of FIG. 1, looking down from above.
Figure 4:
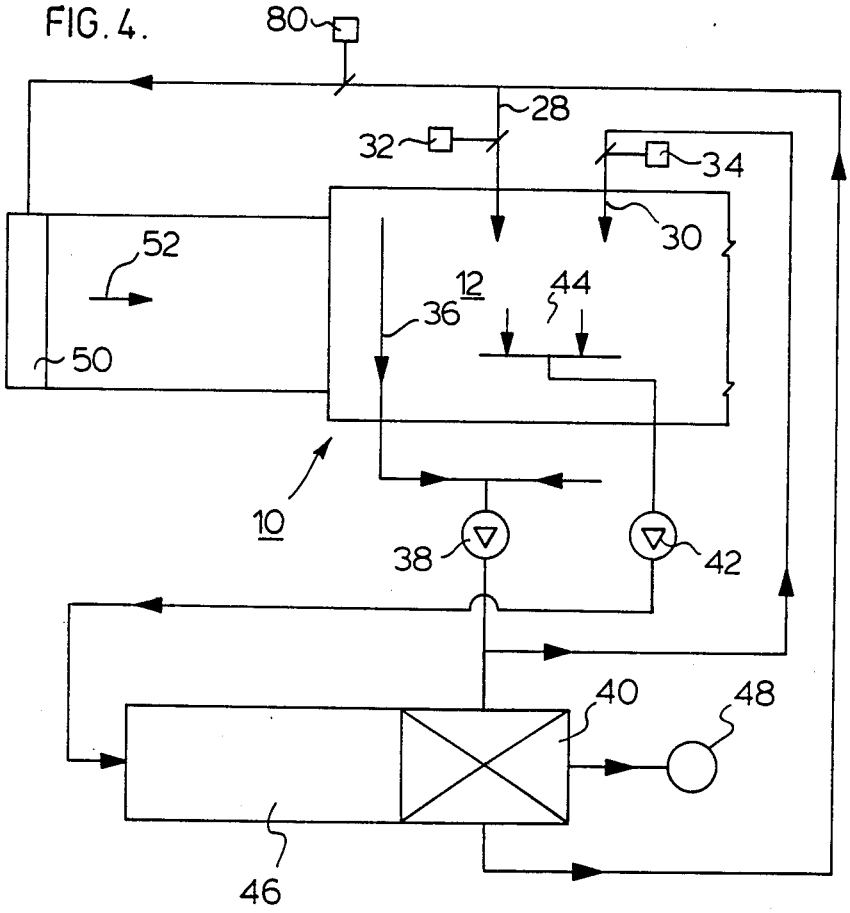
FIG. 4 is a simple schematic of an oven system, with particular reference to the entrance portion which is in accordance with the present invention.

The present invention contemplates that the oven line 10 will have at least a first zone 12, at least a front portion of which is illustrated in FIGS. 1 and 4. The general conditions for the most usual embodiment of the present invention are such that it is used in association with an oven line which is adapted for curing coated product which is coated coiled sheet metal such as steel or aluminum. The coiled sheet metal may pass through the oven in a relatively flat manner such as in a flotation oven, or more usually it will drape through the oven in a catenary, a portion of which is shown at 14. The physical installation of the oven includes a floor 16 in the oven room; and a front wall 18 having an entrance port 20 formed therein, an oven floor 17, and a ceiling or roof 22, formed of refractory material.

Within the oven, there are a number of ducts whose purposes are either to release air into the oven or withdraw air from the interior of the oven. For example, a pair of ducts 24 and 26 is provided to move and release heated air, in the typical embodiment shown, towards the moving catenary 14 both above and below it.

Associated with the oven is a balance air duct 28, whose purpose is to release heated air into the oven zone so as to maintain the temperature in it. A further balance air duct 30 is shown in FIG. 4, and its purpose is to release unheated air into the oven zone, the ratio of flow between the heated and unheated air being under the control of dampers 32 and 34, or otherwise as discussed in the co-pending application noted above.

Particularly as noted in FIG. 4, indraft air to the oven zone 12 may be captured as at 36, and is withdrawn from the oven zone by the balance air fan 38. In the schematic of FIG. 4, which is typical of the kind of oven system referred to in the aforementioned co-pending application, and as discussed above, some of the balance air is returned to the first zone unheated by a line 30, (and to other zones by other lines not shown); and some of it is passed through a heat exchanger 40 to the zone for return as heated air in duct 28, (and to other zones by lines not shown). An exhaust fan 42 effects capture of solvent-rich air from within the oven line, as at 44, and feeds that solvent-rich air as fuel to an afterburner 46. Thereafter, the hot air in which the solvent has been burned off is passed through the heat exchanger 40, without physically contacting the balance air, and may then be exhausted from exhaust stack 48 or be put to other purposes.

It will also be noted in FIG. 4 that a portion of the heated balance air goes past the balance air line 28, and is fed to a plenum 50 which forms a portion of the heated snout 52.

A similar, mirror-image structure, may also be present; and is shown in FIG. 1 at the plenum 54 and lower heated snout 56. A connection for flow of air from plenum 50 and/or duct 62 to plenum 54, or other suitable ductwork to provide heated balance air to plenum 54, is provided but not shown.

Thus, as shown in FIG. 1, a portion of the balance air provides a heated supply of air to zone 12, and is introduced into the zone at 60, under the control of damper 32. The remaining balance air in duct 28 is fed in the duct 62 towards the plenum 50, and thence into the duct 53 (or 57, below the product line) and thereafter back towards the oven. The flow of heated air to the plenum 50 may also be under the control of damper 80.

Figure 3:
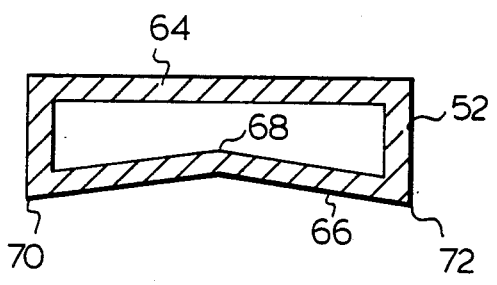
FIG. 3 is a cross-section of an upper snout duct in keeping with a preferred embodiment of the invention, looking in the direction of arrows 3—3 in FIG. 1.

As shown in FIG. 3, the shape or cross-section of the duct 52 of the snout structure according to the present invention may be formed with a relatively flat top surface 64 and a bottom surface 66 in the form of an inverted "V" with its apex at 68. Usually, the width from side to side of the snout 52 is greater than that of the widest coated strip that may pass underneath it; so that, even in the unlikely event of liquid solvent having condensed on the underside of the duct which forms the snout duct 52, it will tend to run downwardly and outwardly towards the outer corners 70 and 72 before dripping off.

Moreover, by incorporating the structure as shown in FIG. 3, a slightly more directed radiant heating occurs where the radiant heat is directed downwardly and inwardly towards the coated product as it passes beneath the heated snout.

A portion of the heated air that reaches the plenum 50 (or 54) may be bled from the plenum as at 74 (or 75), with the rest of the heated air moving downwards towards the oven line as illustrated in FIG. 1. The rest of the air is discharged from the snout at 76 (or 77), just inside the entrance end of the first zone, and at the sides thereof as shown in FIG. 2.

Indraft air that is generally flowing towards the entrance end of the oven, along with the coated product, may in great portion be captured at 78 or 79, where it is then led to duct 82 or 81 under the influence of the intake side of the balance air fan 38.

Other means, including filter 85 and duct 83, are provided to capture the entrance end indraft air, all of which is shown generally at 36 in FIG. 4. Still other means not shown are provided to capture the indraft air which enters the exit end of the oven line, so that in all events means are provided to capture substantially all of the indraft air which enters the oven. That indraft air is, of course, captured by the balance air fan 38, and is immediately removed from the oven line for heating and/or return, as discussed above.

In certain circumstances, it may be possible that the heated balance air that is to be fed to the heated snout may travel in a direction away from the entrance end of the oven line, rather than towards it; but the circuit and air flow as illustrated in FIGS. 1 and 3 are the more usual manner of operation. It may also be arranged that the balance fan is physically located close to the last zone of the oven system. Obviously, the provision of heat at the outside of the entrance port 20 at the entrance end to the oven line serves to reduce any possibility of skinning that the coating material may have if it is too cool. By providing the double skinned heated duct for the snout, heat is brought to the immediate area outside of the entrance end to the oven line, without the risk of any spill of solvent-rich air outside the oven line, because of the high flow of indraft air towards the oven line. Moreover, because the roof of the entrance area to the oven line is heated—that is, the heated snout duct 52—the chances of condensation are substantially reduced or precluded. Still further, the provision of the headers at 78 and 79, at the entrance port 20 to the oven line, assures that most of the indraft air is captured at that point, and high indraft flow is induced. It is clear that by capturing the substantial portion of the cold indraft air at the headers 78 and 79, there is much less cold air entering the first oven zone 12, so that better zone heating is assured.

Because of the possibility that there might be some condensation beneath the header 78, because of the high flow of cold indraft air, enough heated balance air can be bled at 74 so as to slightly preheat the cold indraft air entering the header 78.

It has been noted that an ideal condition to preclude skinning of the coating material on the coated strip is not only to keep the air through which the coated material is moving sufficiently warm so as to preclude premature skinning, but also to heat the coated metal but not the coating material per se. As it happens, the underside of the heated snout duct 52 (and the upper side of the heated snout duct 56, if present and if necessary) functions as a radiant heater, because there is no flow of heated air from the duct and yet it is very warm. That being the case, the radiant heat eminating from the heated snout structure will serve to heat up the metal of the coated product without first heating the coating material, so that curing of the coating material may begin from the metal surface and move upwards (or downwards) to the outer surface. This assures full and complete curing, and precludes blistering or poor adhesion of the coating to the metal.

The temperature of the air moving through the heated duct 52 or 56 of the heated snout may be as high as 900° F., and the average temperature within the oven 12 may be as much as 530° F. or more. The temperature of the coated product, as it enters the heated snout, may be at room temperature or it may be at a slightly higher temperature if the coiled sheet metal has been heated, but not above about 160° F. or so. The temperature of the intake air may be substantially at room temperature, that is from 60° to 90° F.

The above discussion, and description, have been for purposes of illustration of the present invention and without purposes of limiting the same. The scope of the invention is defined in the appended claims.

What is claimed is:

1. An oven system for air curing coated product which is moved in a continuing manner through said oven and is coated with a heat-curable, solvent releasing coating material, comprising:

an oven line having at least one oven zone through which the coated product is arranged to travel, which zone is operated using only air at elevated temperatures;

said oven line having an entrance end for said at least one oven zone and a port through which said coated product enters said oven line from outside said oven line;

means for capturing substantially all indraft air entering said entrance end near said port;

air balance fan means for circulating said indraft air in at least a first volume to a heat exchanger for heating therein to at least said elevated oven temperature, and thence in a return line back to said oven line;

exhaust fan means adapted to withdraw solvent laden air from within said at least one oven zone and thence to deliver said solvent laden air to an afterburner having as its principal fuel source the volatile solvent released from said coating material and contained in said solvent laden air, said afterburner being the heat source for said heat exchanger;

and a snout extending away from said entrance end in a direction opposite to the direction of flow of said coated product as it enters said port;

said snout having therein at least one hollow duct with a surface portion of the duct positioned in close, facing proximity with a major portion of the area of the flow path along which said coated product moves within said snout;

said hollow duct being adapted to receive at least a portion of the heated indraft air in said return line, to elevate the temperature of said duct outer surface to an infrared radiating condition for heating said product and to discharge said heated indraft air into at least one oven zone.

2. The oven system of claim 1, where said heated indraft air in said at least one hollow duct of said snout enters said duct at the end thereof remote from said port.

3. The oven system of claim 2, where means are provided to capture indraft air flowing towards said oven line at at least one position just outside said port.

4. The oven system of claim 2, where a small portion of the heated indraft air is bled past the entrance end of said duct and towards said flow path.

5. The oven system of claim 2, where two hollow ducts are positioned near said flow path, one above and one below.

6. The oven system of claim 1, including filter means to receive indraft air entering said system, for heating in said heat exchanger prior to passage thereof in heating relation with said product.

* * * * *